United States Patent [19]

Olson

[11] Patent Number: 4,542,806

[45] Date of Patent: Sep. 24, 1985

[54] FOLDING MECHANIC'S WORK DOLLY

[76] Inventor: Keith D. Olson, Rte. 1, Box 47, Twin Valley, Minn. 56584

[21] Appl. No.: 300,195

[22] Filed: Sep. 8, 1981

[51] Int. Cl.[4] ..... B25H 5/00

[52] U.S. Cl. ..... 182/152; 182/116

[58] Field of Search ..... 182/152, 116, 115, 15, 182/17, 129, 131; 108/146, 116; 212/182, 183, 184, 142.1; 187/9 R; 280/641, 33.99 H, 47.19, 47.17, 47.18, 47.34, 654

[56] References Cited

U.S. PATENT DOCUMENTS

| | | | |
|---|---|---|---|
| 1,714,932 | 5/1929 | Sundin | 108/116 |
| 1,912,947 | 6/1933 | Martin | 182/152 |
| 2,404,949 | 7/1946 | Delisle | 108/146 |
| 2,701,168 | 2/1955 | Schemers . | |
| 2,739,849 | 3/1956 | Lynn | 182/152 |
| 2,872,252 | 2/1959 | Konkle . | |
| 2,897,910 | 8/1959 | Steeley | 182/15 |
| 2,969,123 | 1/1961 | Jamerson | 182/116 |
| 2,970,668 | 2/1961 | Snyder . | |
| 2,978,754 | 4/1961 | Wilson | 182/131 |
| 2,979,155 | 4/1961 | Scharfendenser . | |
| 3,041,026 | 6/1962 | Wilson | 280/654 |
| 3,052,484 | 9/1962 | Huffman | 280/654 |
| 3,388,820 | 6/1968 | Lebre | 187/9 R |
| 3,493,078 | 2/1970 | Allegri | 187/9 R |
| 3,873,115 | 3/1975 | Shiflet | 280/33.99 H |
| 4,072,209 | 2/1978 | Bolis . | |
| 4,346,906 | 8/1982 | Thorpe | 280/33.99 H |

FOREIGN PATENT DOCUMENTS

| | | | |
|---|---|---|---|
| 163266 | 5/1958 | Sweden | 182/15 |
| 1360192 | 7/1974 | United Kingdom | 187/9 R |

*Primary Examiner*—Reinaldo R. Machado
*Assistant Examiner*—Alvin Chin-Shue
*Attorney, Agent, or Firm*—James R. Haller; Gregory P. Kaihoi

[57] ABSTRACT

A work dolly affording a mechanic access to a vehicle from the top end. The dolly is foldable into a small assembly that takes very little floor space and is provided with a wheeled support that is operable in all modes of operation. Foldable legs lockably coact with an adjustable foldable worker support to provide a compact portable unit when in the storage mode of operation. The worker support portion may be used by the mechanic in either a sitting or prone position.

10 Claims, 7 Drawing Figures

FIG. 2
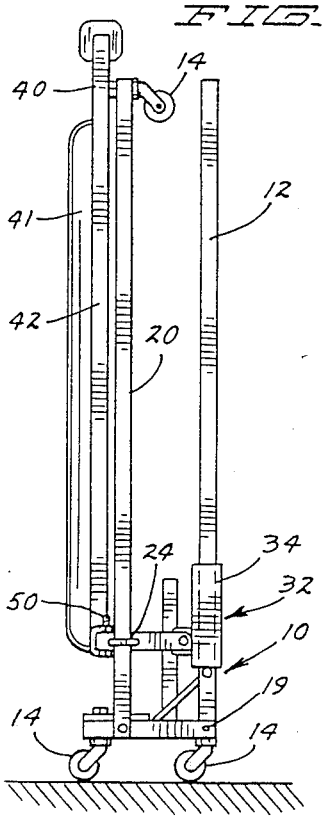
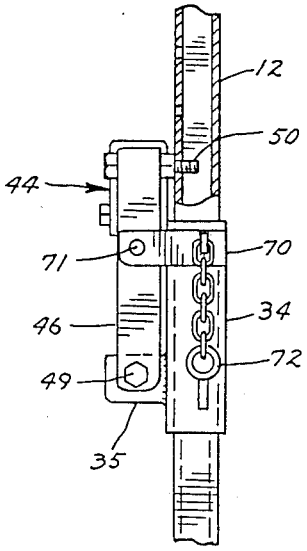
FIG. 6
FIG. 7
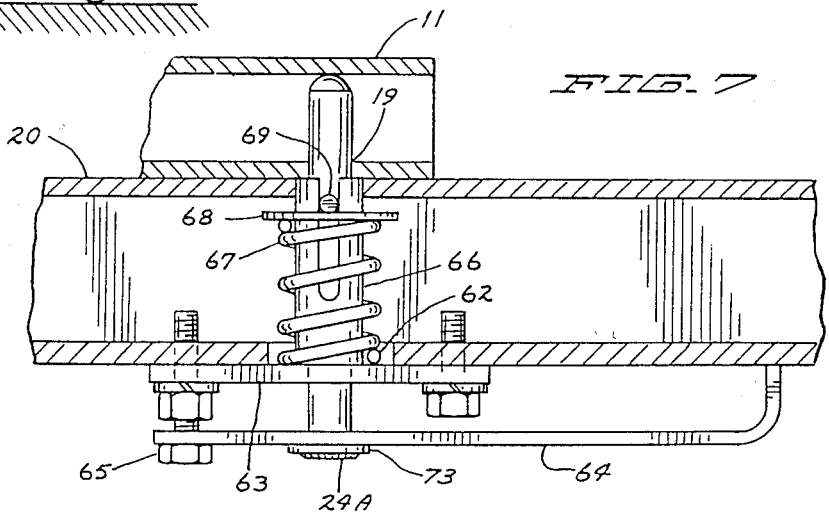

FOLDING MECHANIC'S WORK DOLLY

BACKGROUND OF THE INVENTION

1. Field of the Invention

This invention relates to mechanic's work supports and is more particularly directed to the folding type of mechanic's work dollies that are portable in either a working or a folded storage disposition in which case a minimum of valuable floor space is utilized in a typical mechanic's work environment. My invention is further directed to a mechanic's work dolly which enables the mechanic to service the working elements of a vehicle from a position above the vehicle, a situation that has become commonplace as the complexity of the working elements of a vehicle has increased. The complexity of the vehicles has rendered many of the components that require periodic service attention inaccessible from the historical standing or leaning work position of a mechanic. By providing ready, comfortable access to these components from above portions of the vehicle, the efficiency of the worker is substantially increased while reducing undesirable contact with other portions of the vehicle that are indirectly affected in the performance of services under the historical regime.

2. Description of the Prior Art

The following U.S. patents were noted in the course of a search conducted prior to the preparation of this application;

| U.S. Pat. No. | Inventor | Issued |
|---|---|---|
| 2,701,168 | Schemers | 2/1/55 |
| 2,872,252 | Konkle | 2/3/59 |
| 2,969,123 | Jamerson et al | 1/24/61 |
| 2,970,668 | Snyder | 2/7/61 |
| 2,979,155 | Scharfenberger | 4/11/61 |
| 4,072,209 | Bolis | 2/7/78 |

A consideration of the disclosures of the prior art within the realm of the conscious awareness of the inventor and, as may be appreciated by those skilled in the art to which this invention pertains, can only lead to the valid conclusion that the prior art has recognized some of the problems associated with vehicle maintenance by providing various and sundry forms of foldable, adjustable and portable worker supports which, for reasons unknown, have not found ready acceptance and use in the industry.

BRIEF SUMMARY OF THE INVENTION

One of the objects of this invention is to provide a mechanic's work dolly that is uncomplicated and efficient both in construction and operation.

Another of this invention is to provide a fully portable, foldable mechanic's work dolly having structural integrity in a first working position and in a second storage position.

Another object of my invention is to provide a portable work dolly which requires a minimum of space in the environment in which it is operative when either in a working or storage disposition.

Another object of my invention is to provide an improved, novel and unobvious mechanic's work dolly providing safety of operation.

Briefly, my invention includes a horizontally portable base that is provided with a pair of upstanding legs that slideably, adjustably receive a worker's support platform that is rotatable between vertical and horizontal positions. A pair of stabilizing legs are disposed on the base for operation between horizontal and vertical positions. The support legs may be locked in a horizontal working position to stabilize the portable base and are provided with means for lockably engaging the worker's support when both elements are in a vertical storage position.

BRIEF DESCRIPTION OF THE DRAWINGS

FIG. 2 is a side elevational view of the apparatus of FIG. 1 shown in a folded storage position;

FIG. 6 is an enlarged fragmentary side elevational view, partly in section, of a portion of FIG. 3; and FIG. 7 is an enlarged fragmentary plan view, partly in section, of an alternative embodiment of a portion of FIGS. 1–5.

DESCRIPTION OF THE PREFERRED EMBODIMENT

Figure 1:
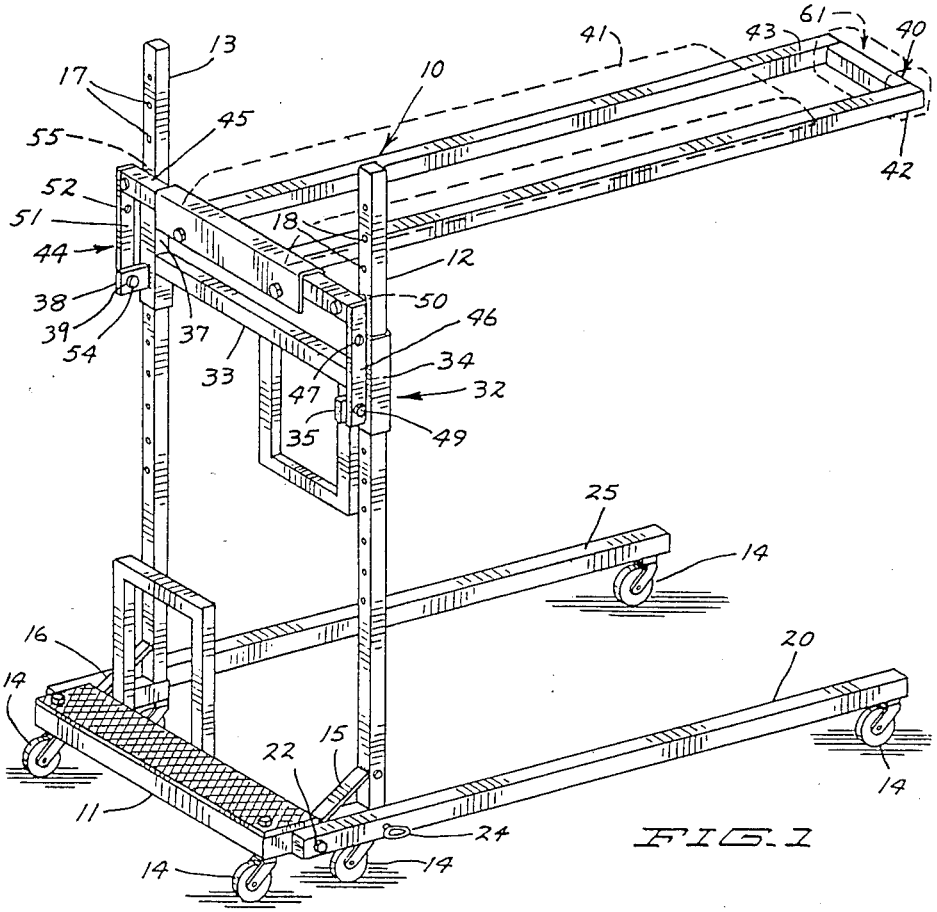
FIG. 1 is a perspective view of my invention shown in working disposition.
Figure 5:
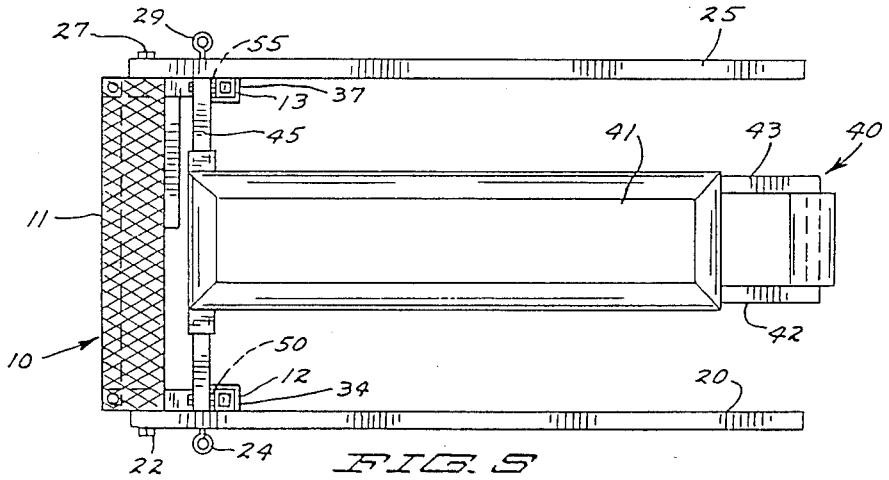
FIG. 5 is a top elevational view of the apparatus of FIG. 1.
Figure 3:
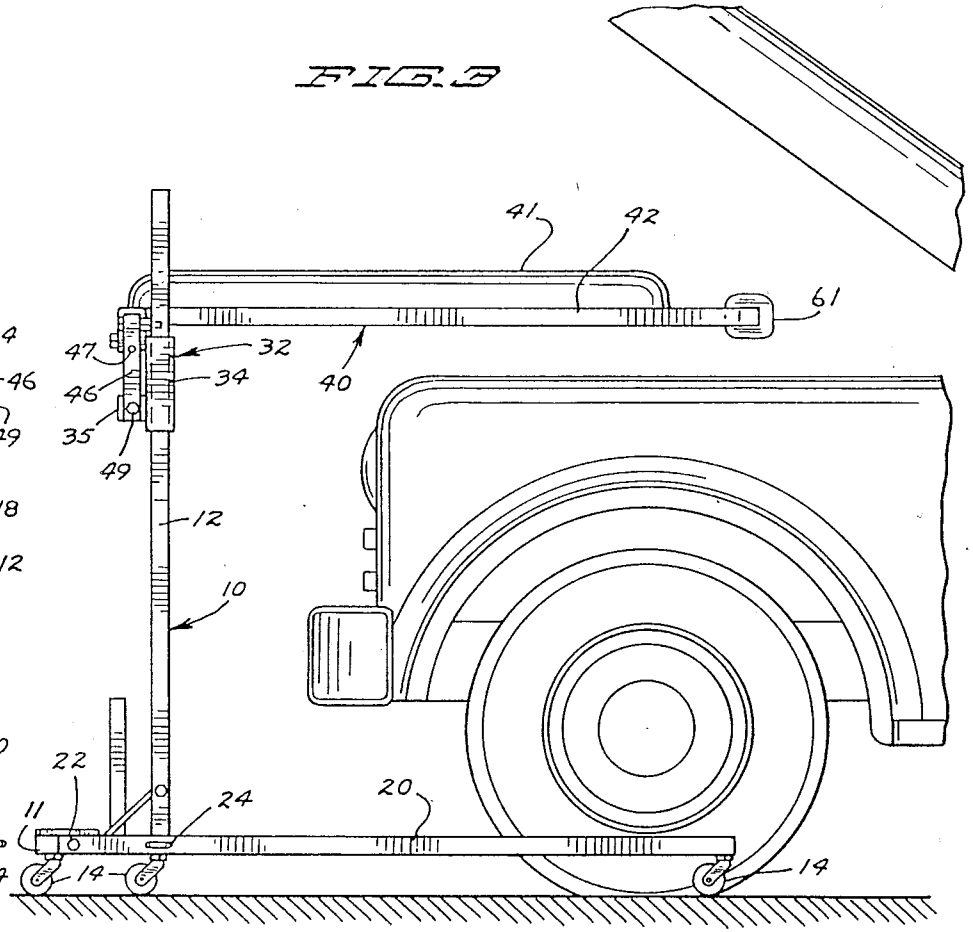
FIG. 3 is a side elevational view of the apparatus of FIG. 1 shown in operative relationship with a vehicle to be serviced.
Figure 4:
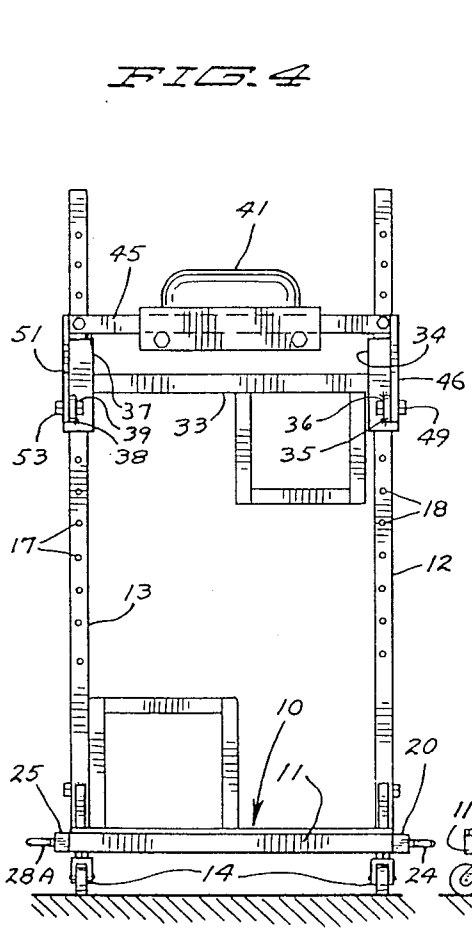
FIG. 4 is a rear elevational view of the apparatus of FIG. 1.

Referring now to FIGS. 1–5 of the drawings, a portable base frame is shown as indicated generally by reference character 10 underneath a worker's support frame, indicated generally by reference character 40.

Base frame 10 is comprised of a U shaped bottom portion 11 having vertically upright members 12 and 13 fastened, as by welding, on the top side of the open ends and retained in such vertical position by suitable brace members 15 and 16 respectively. The forward side portions include suitable locking pin receiving holes (indicated on FIG. 2 by reference character 19). A step-cover plate is disposed on the top of the closed end of U shaped bottom member 11 and includes a further U shaped upwardly extending step member to enable the user to climb into position for servicing a vehicle. A plurality of rotatable casters 14 are disposed underneath each corner of bottom frame 11 to assist in the portability of my work dolly. Upright members 12 and 13 are provided with a plurality of vertically spaced holes 17 and 18 for purposes to be described below.

A pair of stabilizing support legs 20 and 25 are shown rotatably disposed on each side of U shaped bottom portion 11 of portable base frame 10. Leg 20 is rotatably disposed near the side rear of U shaped bottom portion 11 on base frame 10 through suitable bolt means 22 and is provided with a caster, 14, at its forward end. Similarly, leg 25 is rotatably disposed on a bolt, 27, extending into the other rear side portion of U shaped frame 11 and includes a caster, 14, at its forward end. A pair of locking pins shown in the form of eye pins 24 and 29 are shown disposed and extending through the sides of legs 20 and 25 respectively for lockable engagement with holes 19 in the front sides of U shaped frame 11.

Worker support 40 is shown disposed on a sliding frame, indicated generally by reference character 32, that includes right and left side members 34 and 37 adopted to be slideably received on upright legs 12 and 13 on base frame 10. Right and left side portions 34 and 37 are interconnected and held spaced apart by a center member 33. Right side portion 34 includes a bracket 35 having an aperture 36 and left side 37 includes a bracket 38 having an aperture 39. A user's step is shown in the form of the downwardly depending U shaped member attached to the underside of center portion 33 on sliding frame 32 and, as may be seen, is spaced and dimensioned so as to permit non-interferring slideable disposition of sliding frame 32 with the upwardly extending step portion on base frame 10.

Worker's support 40 is shown comprised of a pair of parallel support rails 42 and 43 that are connected by suitable means at the forward end and are connected to a swing frame 44 at the rear end. Suitable padding material for the body, or the like, of a user is indicated by reference character 41 and for the head, as indicated by reference character 61. Swing frame 44 includes a horizontally disposed cross-member 45 and an extension member 46,51 on each end that is substantially perpendicular to the longitudinal axis of support rails 42 and 43. The right side extension member, 46, is provided with a locking pin aperture 47 and is rotatably disposed on extension 35 on sliding frame 32 through a suitable bolt, 49. Left side extension member 51 similarly includes an aperture 52 for receiving a locking pin and is rotatably disposed on extension 38 on the left side 37 of sliding frame 32 through a suitable bolt 54. A pair of locking pins 50 and 55 are shown disposed adjacent the ends of cross member 45 to extend therefrom into complementary disposed apertures 18 and 17 in upright portions 12 and 13 on base frame 10 respectively.

FIG. 6 illustrates a safety lock for maintaining worker support 40 in the horizontal working position and includes a bracket 70 attached, as by welding, to the right and left sides 34 and 37 of sliding frame 32 and includes an aperture 71 disposed to overlie apertures 47 and 52 in swing frame 44 to receive a suitable locking pin, 72.

FIG. 7 illustrates another embodiment of a locking pin that may be utilized in connection with legs 20 and 25. The locking pin is indicated by reference character 24A and is adapted to be slideably inserted into aperture 19 in the front sides of U shaped frame 11. Locking pin 24A extends through a plate 63 that is suitably disposed over an aperture 62 in the outside of legs 20 and 25. A sleeve 66 is shown extending inwardly from plate 63 through aperture 62 and includes a slot for slideably receiving a cross pin 69 extending through locking pin 24A into proximity with the topside of washer 68 that is disposed on top of a coil spring 67. An operating lever 64 is shown rotatably disposed on bolt 65 at one end. The outer end of locking pin 24A, having washer 73, welded in place, extends through lever 64 adjacent bolt 65.

OPERATION OF THE ILLUSTRATED EMBODIMENT

Referring to FIG. 2, wherein my invention is shown in the folded storage disposition, it may be noted that the folded mode of operation presents a balanced, compact, portable apparatus wherein the weight of the upwardly extending, compact assembly is distributed evenly over base 10, and the assembly is locked in the storage mode with locking pin 24 extending through leg 20, into aperture 47 in the side of swing frame 44.

When it is desired to service a vehicle, the assembly just described is transported, as by rolling, to the location of the vehicle and locking pins 24 and 29 in legs 20 and 25 are withdrawn to allow movement of legs 20 and 25 from the vertical storage position to the horizontal working support position and eye pins 24 and 29 are inserted into apertures 19 in the front side portions of U shaped frame 11 to lock the legs into position. At this point, the entire apparatus is fully portable and the casters, 14, on the forward ends of legs 20 and 25 are in operative engagement with the work surface adjacent the vehicle to be serviced to provide a stable portable base.

Sliding frame 32 is raised vertically on legs 12 and 13 to a horizontal position that is above the portion of the vehicle to be serviced. Worker support frame 40 is rotated from its vertical position to a horizontal position whereat locking pins 50 and 55 are inserted into complementary disposed apertures 17 and 18 in upright members 13 and 12 to lock sliding frame 32 in the desired position as worker support 40 is rotated into a horizontal worker supporting position. The entire apparatus is then transported into a suitable position with respect to the vehicle to be serviced.

The mechanic may climb upon the horizontal surface of worker support 40 and work in a sitting or prone position in which the body will be supported by the padding assembly 41 and the head may be supported by padding assembly 61 at the front end of worker support 40.

In an embodiment utilizing the features illustrated in FIG. 6, whenever the worker support portion 40 is in a horizontal position, locking pin 72 may be inserted through aperture 71 into aperture 47 in the side 46 of swing frame 44.

The embodiment of FIG. 7 is believed self-explanatory and provides a locking pin assembly that is easily and positively operable while remaining as an integral portion of the overall structure assembly.

I claim:

1. A portable foldable mechanic's work dolly comprising, in combination;

a horizontally disposed base member stably supportable upon a horizontal surface and including a pair of spaced, parallel legs extending vertically upwardly therefrom;

slideable base means disposed on and extending between said parallel legs;

worker's support means rotatably disposed on said sliding base means, operable between a vertical storage position and a horizontal position;

locking means operable to restrain said slideable base means when said worker's support means is in said horizontal position; and foldable support means rotatably disposed on said base member and operable between a vertical storage position and a horizontal position in stabilizing contact with the horizontal surface underneath said worker support means when the latter is in its horizontal position, the foldable support means and the worker's support means when in their respective vertical positions being carried by the horizontally disposed base in a compact orientation with the weight of the vertical elements distributed for balance over the base member, whereby the dolly may be stably supported about a horizontal surface for storage;

the parallel legs on the base member including a plurality of vertically spaced complimentary disposed locking apertures and the working support means including a pair of locking pins disposed to engage an aperture on each of the legs when said worker's support means is in said horizontal position.

2. The apparatus of claim 1 in which a further locking means is disposed on the slideable base member to operably engage said worker support means when said worker support means is in said horizontal position.

3. A portable foldable mechanic's work dolly comprising, in combination;

a horizontally disposed base member stably supported upon a horizontal surface and including a pair of spaced parallel legs extending vertically upwardly therefrom;

slideable base means disposed on and extending between said parallel legs;

worker's support means rotatably disposed on said sliding base means, operable between a vertical storage position and a horizontal position;

locking means operable to restrain said slideable base means when said worker's support means is in said horizontal position, comprising respective engageable means carried by the worker's support means and the pair of vertical legs and engageable when the worker's support means is rotated to its horizontal position to lock the latter against vertical movement with respect to the vertical legs; and foldable support means rotatably disposed on said base member and operable between a vertical storage position and a horizontal position in stabilizing contact with the horizontal surface underneath said worker's support means when the latter is in its horizontal position, the foldable support means and the worker's support means when in their respective vertical positions being carried by the horizontally disposed base in a compact orientation with the weight of the vertical elements distributed for balance over the base member, whereby the dolly may be stably supported upon a horizontal surface for storage.

4. The apparatus of claim 3 in which the foldable support means includes a pair of parallel legs each pivotally attached at one end to the base member and having means at their other ends for supportive contact with a horizontal surface upon which the base member is stably supported when the foldable support means is in its horizontal position.

5. The apparatus of claim 4 in which further locking means disposed on the foldable support means is operable to engage the base member when said foldable support means is in said horizontal position and to engage said worker support means when said worker support means and said foldable support means are in said vertical position.

6. A portable foldable mechanic's work dolly comprising, in combination;

a U-shaped, horizontally disposed base member including a pair of parallel legs extending vertically upwardly from the ends of the open end thereof;

slideable base means disposed on and extending between said parallel legs;

worker support means rotatably disposed on said sliding base means and operable between a first vertical position and a second horizontal position;

locking means operable to restrain said sliding base means when said worker support means is in said second position;

foldable support means rotatably disposed on said U-shaped base member at one end and operable between a first vertical position and a second horizontal position underneath said worker support means; and further locking means disposed on the foldable support means and operable to engage the base member when said foldable support means is in said second horizontal position and to engage said worker support means when said worker support means and said foldable support means are in said first vertical position.

7. The apparatus of claim 6 in which the further locking means includes a pin member, and biasing means therefor, and complementary disposed apertures disposed in the base member and the worker support means.

8. The apparatus of claim 6 in which a plurality of support wheels are disposed under the base member and the other end of the foldable support means.

9. The apparatus of claim 6 in which the foldable support means includes a pair of parallel legs.

10. The apparatus of claim 6 in which the parallel legs on the base member include a plurality of vertically spaced complementary disposed locking apertures and the worker support means includes a pair of locking pins disposed to engage an aperture on each of the legs when said worker support means is in said second horizontal position.

* * * * *